US008966790B2

(12) United States Patent
van de Coterlet

(10) Patent No.: US 8,966,790 B2
(45) Date of Patent: Mar. 3, 2015

(54) DEVICE FOR DIGGING A TRENCH

(71) Applicant: Sterk Cellar Murum B.V., Eemnes (NL)

(72) Inventor: Johannes Gerardus van de Coterlet, CW Bunschoten (NL)

(73) Assignee: Sterk Cellar Murum B.V., LD Eenmes (NL)

( * ) Notice: Subject to any disclaimer, the term of this patent is extended or adjusted under 35 U.S.C. 154(b) by 112 days.

(21) Appl. No.: 13/749,916

(22) Filed: Jan. 25, 2013

(65) Prior Publication Data

US 2013/0192097 A1 Aug. 1, 2013

(30) Foreign Application Priority Data

Jan. 25, 2012 (NL) ..... 2008177

(51) Int. Cl.

| | |
|---|---|
| ***E02F 3/28*** | (2006.01) |
| ***E02F 3/10*** | (2006.01) |
| ***E02D 17/13*** | (2006.01) |
| ***E02F 5/06*** | (2006.01) |

(52) U.S. Cl.

CPC . *E02F 3/10* (2013.01); *E02D 17/13* (2013.01); *E02F 5/06* (2013.01)

USPC ..... 37/352

(58) Field of Classification Search

USPC ..... 37/349, 352–360, 142.5, 361, 362, 37/462–464; 172/100; 405/266–271, 286, 405/287, 287.1, 233, 236, 240–242; 299/18, 64, 76, 80, 84

See application file for complete search history.

(56) References Cited

U.S. PATENT DOCUMENTS

| | | | | |
|---|---|---|---|---|
| 5,497,567 | A * | 3/1996 | Gilbert | 37/352 |
| 8,079,163 | B2 * | 12/2011 | Shreider et al. | 37/462 |
| 2007/0056425 | A1 | 3/2007 | Bonar | |
| 2009/0260264 | A1 | 10/2009 | Cooper et al. | |

OTHER PUBLICATIONS

Dutch Search Report dated Nov. 19, 2012, corresponding to the Foreign Priority Application No. NL2008177.

* cited by examiner

*Primary Examiner* — Robert Pezzuto
(74) *Attorney, Agent, or Firm* — Young & Thompson

(57) ABSTRACT

An excavator (1) includes a frame (2) provided with suspension elements (3) for connecting to a mobile carrier, such as a tracked vehicle, as well as cutting members (8) supported on the frame (2) for digging a trench in the ground. The cutting members (8) have at least two endless series (9, 10) of cutting elements; at the same time, the cutting elements (9, 10) define a front side (11) to be turned towards a digging front and a return side (12) turned away from the digging front. Lateral guides (14) are provided on either side of the cutting members (8) for supporting the side walls of the trench.

20 Claims, 6 Drawing Sheets

DEVICE FOR DIGGING A TRENCH

CROSS-REFERENCE TO RELATED APPLICATIONS

This application claims the benefit of priority to Dutch Patent App. No. NL 200817 filed on Jan. 25, 2012.

BACKGROUND OF THE INVENTION

1. Field of the Invention

The invention relates to a device for digging a trench, comprising a frame provided with suspension means for connecting to a mobile carrier, such as a tracked vehicle, cutting means supported on the frame for making a trench in the ground, which cutting means have at least an endless series of cutting elements and define a front side to be turned towards a digging front and a return side which is turned away from the digging front, as well as lateral guides on either side of the cutting means for supporting the side walls of the trench.

2. Description of the Related Art

An excavator of this type is known from NL-A-1007263. The cutting means thereof are configured as an endless chain which is guided around upper and lower deflecting rollers. During excavation of the trench, the excavator is advanced by the tracked vehicle from which the excavator is suspended. The excavated trench is filled with concrete. The concrete filling acts as a support for the walls of the trench, so that they are secured against collapse. In addition, the concrete filling exerts pressure on the excavator. As a result thereof, the cutting means are pushed down in the direction of the digging front, which advantageously affects the operation of the cutting means.

The width of the trench is defined by the width of the cutting means, in particular the front side thereof. Immediately after the trench has been excavated, it has to be protected from collapsing by the lateral guides of the excavator. It is desirable for the walls of the trench not to touch the return side of the series of cutting elements, as the walls could otherwise be disturbed and be at risk of collapse.

BRIEF SUMMARY OF THE INVENTION

It is therefore an object of the invention to provide an excavator of the abovementioned type which does not have these drawbacks. This object can be achieved by providing the cutting means with at least two series of cutting elements which extend next to one another and by making the front side of the cutting means wider than the return side.

The arrangement next to one another of two series of cutting means which together form the front side and the return side of the cutting means makes it possible to carry out the excavating work in a more flexible manner while taking into account the problems associated with the soil pressure. In particular, the cutting means are configured in such a manner that the front side thereof is wider than the return side. In this case, the width of a side is understood to be the distance between the opposite longitudinal edges of a side. The depth of the cutting means determines the mutual distance between the sides and is at right angles to the width and the longitudinal direction of at least one of the sides. The width of the front side can be adapted by suitably selecting the mutual distance of the series; consideration may be given to moving the cutting elements with respect to each other in the width direction at the transition thereof between the front side and the return side. Preferably, however, the series of cutting elements are oriented obliquely with respect to each other.

The oblique position with respect to each other makes it possible for the width of the series of cutting elements on the front side to differ from the width on the return side. In this case, it may in particular be provided that the front side determined by the series of the cutting means is wider than the return side determined by the series of the cutting means. A wider front side makes it possible to excavate a trench which is at least as wide as the other parts of the excavator, in particular compared to the width at the location of the lateral guides and at the location of the return side. The series of cutting elements preferably move at the same speed when carrying out the excavation work.

The front side of the series of cutting elements may have a width which is equal to, or greater than, the external width defined by the distance of the surfaces of the lateral guides facing away from each other.

The lateral guides can be arranged parallel to one another which is advantageous in order to prevent large forces resulting from the soil pressure when advancing the excavator. On the other hand, the return side of the cutting means can be accommodated between and screened off from the surrounding soil by the lateral guides. Consequently, disturbance of the newly excavated trench walls is likewise prevented. It is particularly advantageous if the front side of the series of cutting elements protrudes laterally with respect to the lateral guides. The resulting space in the trench outside the lateral guides is preferably filled with bentonite cement which prevents expansion of the soil. In addition, the bentonite cement reduces the friction between the soil and lateral guides, as a result of which the progress of the excavation work is assisted further.

In order to achieve an even excavating effect using the two series of cutting elements, it may be provided that the cutting elements of the one series mesh with the cutting elements of the other series and the cutting elements of the front side which are arranged next to one another in each case enclose an opening. The alternately meshing cutting elements of the two series ensure that an even excavating effect is also achieved at the interface between the two series.

Furthermore, the cutting elements of in each case one and the same series may have a different width. In this case, a relatively wide cutting element of one of the series may be situated next to a cutting element of the other series which has a relatively small width. The cutting elements may be configured in many different ways, depending on the trench to be excavated and the properties of the soil in which it is to be dug. By way of example, the cutting elements of each series may each comprise a plate, which plates are attached to one another so that they can pivot with respect to each other. An excavating projection may be provided on each plate. The lateral guides may be configured as side walls which are attached to the frame so as to form a U-shaped cross section, the opening of which is turned in the direction of the front side; these side walls are preferably mutually parallel. Furthermore, the lateral guides may be connected to each other by a rear wall which is situated opposite the return side of the cutting means. The rear wall may serve as shuttering for concrete and the like which is poured into the latter immediately after the trench has been dug.

The lateral guides may extend with respect to the rear wall in the direction turned away from the front side so as to form a U-shaped cross section, the opening of which is turned away in the direction of the front side. If the width of the return side is narrower than the width of the space enclosed by the lateral guides, the return side can preferably be situated in the intermediate space between the lateral guides and overlap the lateral guides. These parts of the lateral guides situated behind the rear wall block the flow of cement to the space where the cutting means are situated. The overlapping of the lateral guides and the return side of the cutting means means that the return side is situated within the space which is enclosed by said lateral guides. The return side is thus separated from the surrounding soil by said lateral guides, in such a manner that the soil cannot be stirred by the return side.

In order to further prevent bentonite or liquid cement from getting into the space where the cutting means are located, a flexible flap may be provided on or near the bottom side of the rear wall and/or the lateral guides, which flap is rotatable about a rotary shaft at right angles to the lateral guides. When the excavator is being introduced into the soil, the flap is pushed upwards in such a manner that it does not form an obstacle. As soon as the excavator has reached the desired depth in the soil and the excavator is moved forwards through the soil so as to form a trench, the flap moves to an approximately horizontal position and then drags across the bottom of the trench. In this position, the flap efficiently prevents the cement from flowing along the bottom of the rear wall.

With a view to simplifying the introduction of the excavator into the soil, an auxiliary cutter may be provided on or near the bottom side of the rear wall and/or the lateral guides; the rotary shaft may be oriented at right angles to the lateral guides. During the introduction into the soil, said cutting device cuts away the soil underneath the excavator in such a manner that a suitable hole is produced by the cutting action of the double cutting means.

The series may be guided over roller means. Said roller means may in each case comprise two rollers arranged next to one another, the axes of which are oriented obliquely with respect to one another. Preferably, the axes of two rollers arranged next to one another intersect. The axes are rotatable with respect to each other about an axis of rotation which runs parallel to the longitudinal direction of the cutting means. The two series of cutting means are also rotatable with respect to each other about said axis of rotation. The longitudinal direction of both series of cutting means is parallel.

As has been mentioned above, the lateral guides or side walls may also be parallel with respect to each other. However, this is not imperative, so the mutual distance between the side walls at the edge thereof turned towards the front side of the cutting means may be greater than at the opposite edge thereof. In the latter case, the concrete filling of the trench exerts a further propelling force onto the excavator, in addition to the propulsion which has already been supplied by the concrete filling which pushes against the rear wall of the excavator.

The mutual distance between the series may be fixed or adjustable. In the latter case, the width of the trench to be excavated can be chosen by suitably selecting the mutual distance between the cutters. In this case, the series may be moved with respect to one another, either away from each other or towards each other. As has been mentioned above, it is possible, according to another possibility, for the series to be rotatable with respect to each other about an axis which runs parallel to the series.

Lastly, the invention relates to the combination of an excavator as described above as well as a mobile carrier, such as a tracked vehicle, provided with carrier means to which the suspension means of the excavator are attached.

BRIEF DESCRIPTION OF THE DRAWINGS

The invention will be explained in more detail below with reference to an exemplary embodiment illustrated in the figures, in which.

DETAILED DESCRIPTION OF THE PREFERRED EMBODIMENTS

Figure 1:
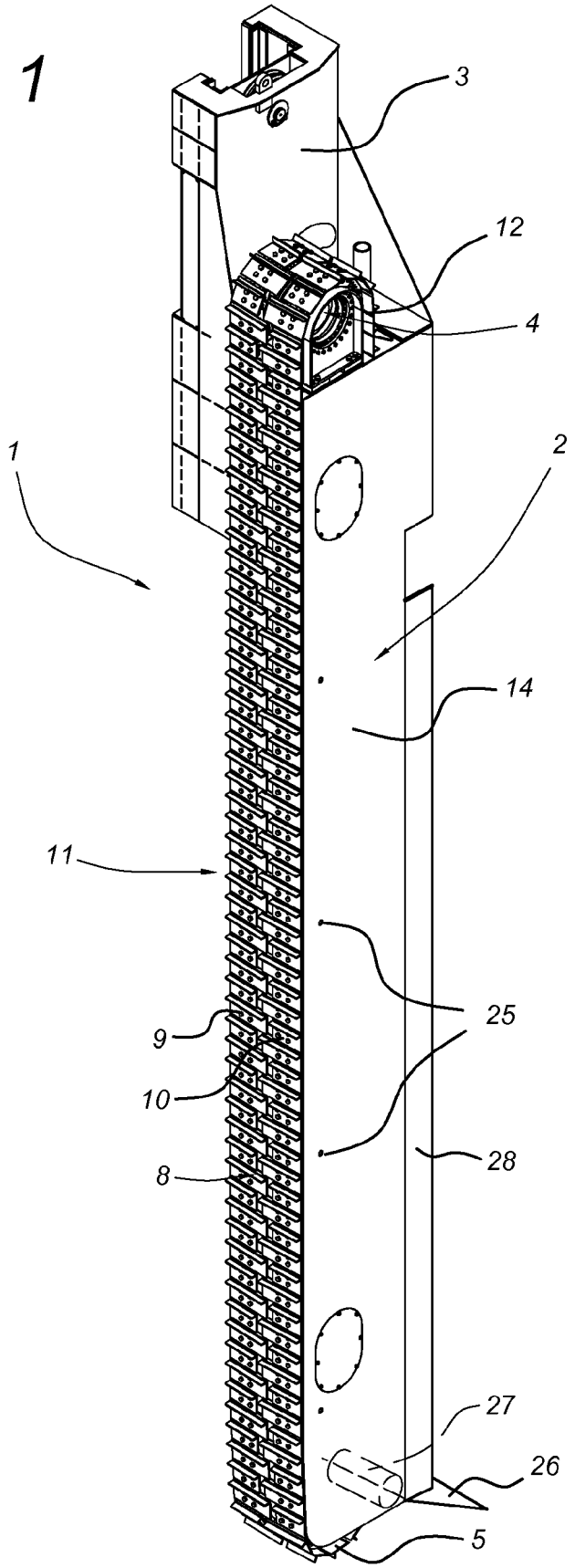
FIG. 1 shows a front view in perspective of the excavator according to the invention.
Figure 2:
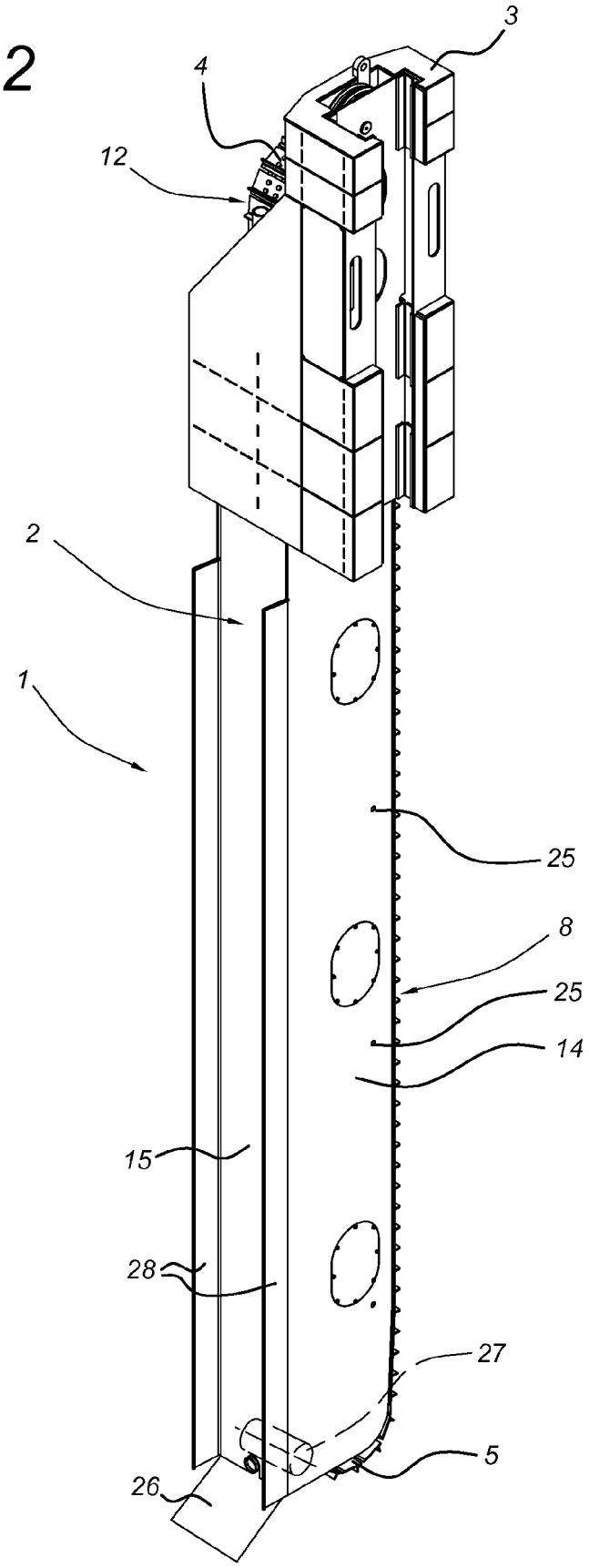
FIG. 2 shows a rear view in perspective.
Figure 5:
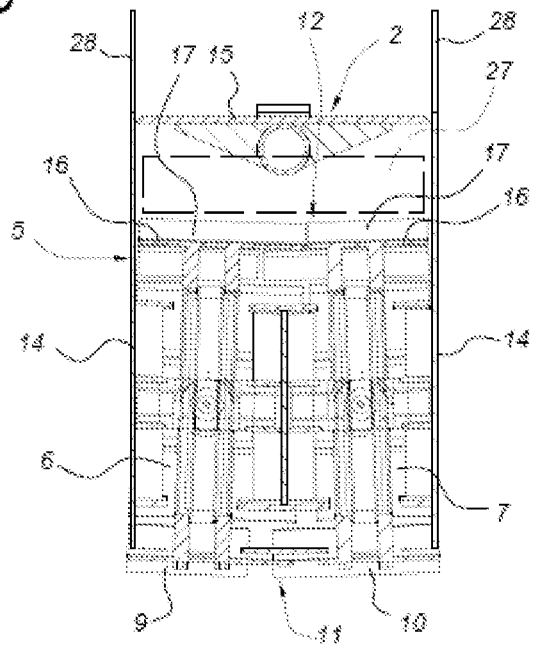
FIG. 5 shows the cross section according to V-V from FIG. 3.

The excavator 1 according to the invention and illustrated in FIGS. 1 and 2 consists of the elongate frame 2 to which the carrier 3 is fitted. On the frame, the upper roller means 4 and the lower roller means 5 are mounted. Each of these roller means 4, 5 consists of two rollers 6, 7 which are arranged next to one another and the axes of which make a small angle $\alpha$ with each other, as is shown in FIG. 5.

Figure 3:
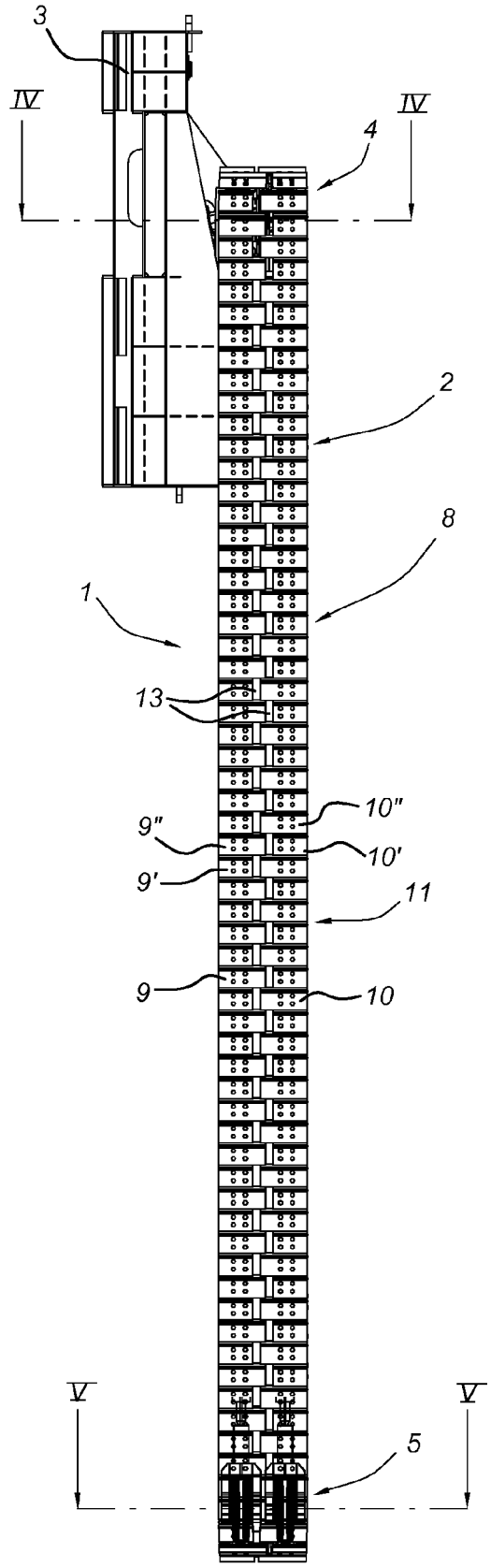
FIG. 3 shows the front view.
Figure 4:
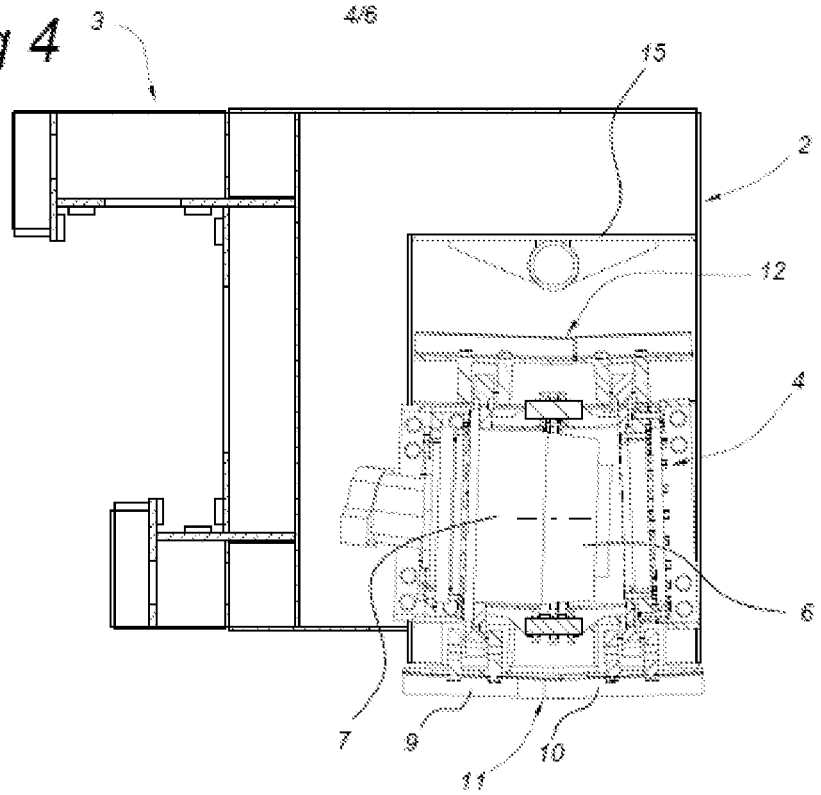
FIG. 4 shows the cross section according to IV-IV from FIG. 3.

Cutting means which are denoted overall by reference numeral 8 are guided over these roller means 4, 5. These cutting means 8 consist of the two series 9, 10 of cutting elements. In the view from FIGS. 1 and 3, the front side 11 of the cutting means 8 can be seen. The return side 12 is situated behind the front side, as is illustrated in FIGS. 1 and 2. Each of these series of cutting elements 9, 10 consists of relatively narrow cutting elements 9' and of relatively wide cutting elements 9", and relatively narrow cutting elements 10' and relatively wide cutting elements 10", respectively, which in each case consist of a plate 16 and an excavation projection 17. The plates 16 of each series are connected to one another in a pivoting manner. The relatively wide cutting elements 9" of the series of cutting elements 9 in each case protrude between the relatively wide cutting elements 10" of the series of cutting elements 10. In addition, a relatively narrow cutting element 10' and 9', respectively, is situated next to each relatively wide cutting element 9" and 10", respectively.

As is illustrated, the cutting elements 9", 10' and 9', 10", respectively, enclose an opening 13 at the location of the front side 11. Due to the presence of these openings 13, the front side 11 of the cutting means 8 is wider than the return side 12 thereof. At the location of the return side 12, said opening is smaller or even completely absent. The series of cutting elements 9, 10 are therefore oriented slightly obliquely with respect to each other, in accordance with the oblique position of the rollers 6, 7.

The side walls 14 are present on either side of the frame 3 and are connected to each other at the rear side, opposite the return side 12, by a rear wall 15. Due to the relatively large width of the front side 11, it protrudes with respect to the side walls 14, both in the transverse direction and in the direction at right angles to the front side 11. The return side 12 is narrower and is concealed between the side walls 14. Due to these differences in width between the front side 11 and the return side 12, the side walls 14 may be parallel to one another, while the front side 11 still protrudes with respect to the side walls 14 and the return side 12 is screened off between the side walls 14. The rear wall 15 can serve as shuttering for concrete which can be poured immediately after the trench has been dug. Via the inlet 18, the concrete can be introduced at the bottom of the excavated trench. Furthermore, introduction openings 25 for bentonite cement are provided along the height of the side walls 14. The bentonite cement reduces the friction between the side walls and the trench, which has an advantageous effect on the progress of the excavating work. In addition, the introduction of the bentonite cement prevents expansion of the soil.

Beyond the rear wall 2, the side walls 14 are extended by means of flanges 28 which define a U shape, the opening of which is turned away from the cutting means. These flanges may be flexible and/or be suspended so as to be rotatable about a vertical shaft. The U shape prevents bentonite or cement from penetrating into the other U-shaped space, the opening of which is turned towards the cutting means. The cutting means are situated in the latter U shape. On the bottom side of the rear wall 2, the flexible flap 26 is provided, or a flap which is rotatable about a horizontal shaft. When the excavator is being introduced into the soil, said flap 26 is folded up, against the rear wall 2. Once the desired depth has been reached and the excavator starts to move forwards through the soil, said flap moves to a more horizontal position and covers the bottom of the dug trench at the same time, thus preventing the bentonite or cement from reaching the cutting means.

The excavator is moved down into the soil by the action of the cutting means 8. In order to be able to also move the parts of the excavator situated behind the cutting means 8, an auxiliary cutter 27 is arranged on the bottom side of the rear wall 2, behind the cutting means 8. Said auxiliary cutter 27, which is rotatable about a horizontal shaft, removes the soil material which is situated near and/or under the rear wall 2.

Figure 6:
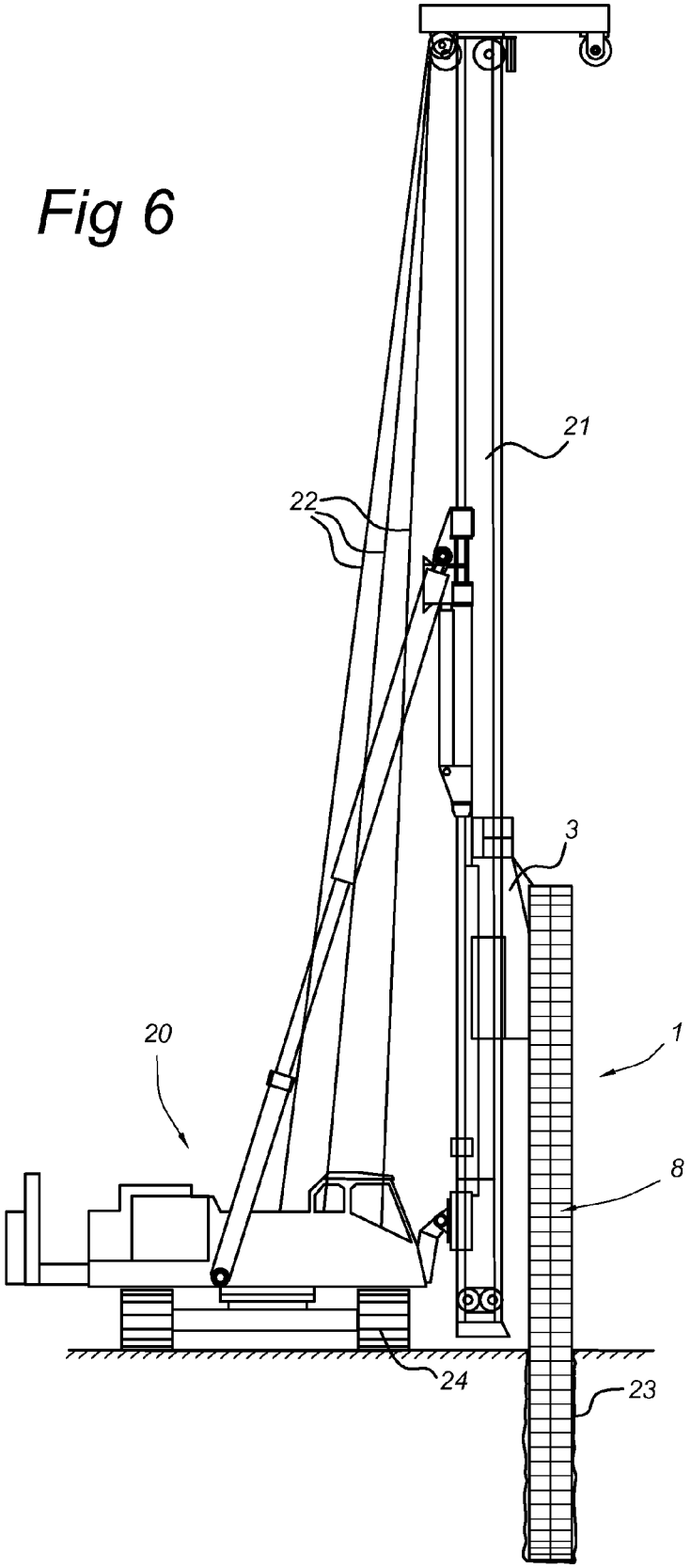
FIG. 6 shows the excavator as supported on a vehicle.
Figure 7:
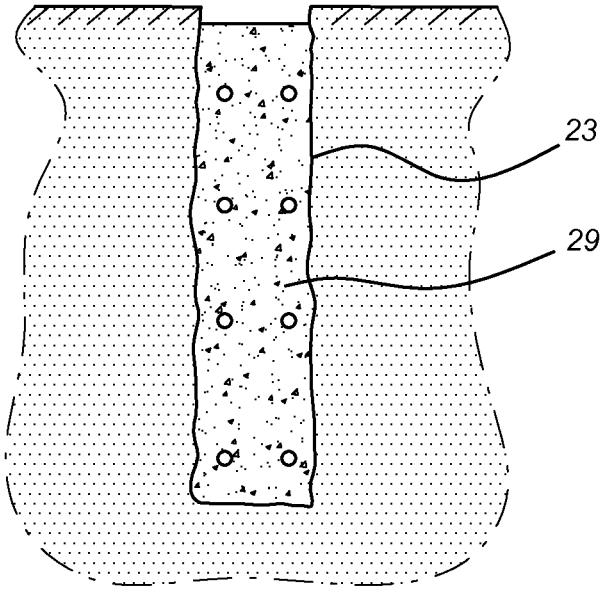
FIG. 7 shows a wall produced in the soil.

The excavator 1 according to the invention can be suspended from a tracked vehicle 20 by means of the carrier 3, as is illustrated in FIG. 6, in such a way that the excavator 1 can be advanced during digging of a trench. On the tracked vehicle, a king post 21 is fitted in a known manner, along which the carrier 3 of the excavator 1 can be moved up and down by means of cables 22. In the position illustrated in FIG. 6, the excavator 1 has excavated a trench of a limited height into the ground. When the excavating work is continued, the excavator can be moved further into the ground. In this case, the undercarriage 24 of the tracked vehicle 20 drives along the trench 23 under construction, in such a manner that the desired length of the trench can be achieved.

LIST OF REFERENCE NUMERALS

1. Excavator
2. Frame
3. Carrier
4. Upper roller means
5. Lower roller means
6. Oblique roller
7. Oblique roller
8. Cutting means
9. Series of cutting elements
9'. Relatively narrow cutting element
9". Relatively wide cutting element
10. Series of cutting elements
10'. Relatively narrow cutting element
10". Relatively wide cutting element
11. Front side
12. Return side
13. Opening
14. Side wall
15. Rear wall
16. Plate
17. Excavation projection
18. Inlet for concrete
19. Inlet for bentonite cement
20. Tracked vehicle
21. King post
22. Cable
23. Trench
24. Undercarriage
25. Introduction opening
26. Flap
27. Auxiliary cutter
28. Flange
29. Wall

The invention claimed is:

1. An excavator, comprising:
a frame provided with suspension means for connecting to a mobile carrier;
cutting means supported on the frame, the cutting means configured to form a trench in the ground, the cutting means including
at least two series of cutting elements extending next to one another,
a front side facing a digging front, and
a return side configured to face away from the digging front, a maximum width of the front side of the cutting means being wider than a maximum width of the return side of the cutting means; and
lateral guides on the front side and the return side of the cutting means to support side walls of the trench.

2. The excavator according to claim 1, wherein the at least two series of cutting elements are oriented obliquely with respect to each other.

3. The excavator according to claim 1, wherein the cutting elements of one of the at least two series mesh with the cutting elements of another of the at least two series.

4. The excavator according to claim 1, wherein the cutting elements of the front side each enclose an opening.

5. The excavator according to claim 1, wherein the front side of the series of cutting elements has the maximum width which is equal to or greater than the external width defined by the distance of the surfaces of the lateral guides facing away from each other.

6. The excavator according to claim 5, wherein the side walls are parallel with respect to each other, or the mutual distance between the side walls at an edge thereof facing the front side of the cutting means is greater than at an opposite edge thereof.

7. The excavator according to claim 1, wherein the lateral guides are connected to each other by a rear wall which is situated opposite the return side of the cutting means so as to form a U-shaped cross section, an opening of the U-shaped cross section facing the direction of the front side.

8. The excavator according to claim 7, wherein the lateral guides extend with respect to the rear wall in a direction away from the front side so as to form a U-shaped cross section having an opening, the opening of the U-shaped cross-section being disposed away from the front side.

9. The excavator according to claim 8, wherein the lateral guides extend with respect to the rear wall in the direction away from the front side in the form of a flexible flap or in the form of a flap which is rotatable about a vertical pivot pin.

10. The excavator according to claim 1, wherein the maximum width of the return side is smaller than the width of the space enclosed by the lateral guides, the return side being situated in the intermediate space between the lateral guides and overlapping the lateral guides.

11. The excavator according to claim 1, further comprising a flap provided on or near the bottom side of the lateral guides, the flap being rotatable about a rotary shaft at right angles to the lateral guides.

12. The excavator according to claim 1, further comprising an auxiliary cutter provided on or near the bottom side of the lateral guides, the rotary shaft of the rotary cutter being oriented at right angles to the lateral guides.

13. The excavator according to claim 1, wherein the series are guided over roller means, the roller means each comprising two rollers arranged next to one another, the axes of which are oriented obliquely with respect to one another.

14. The excavator according to claim 1, wherein the mutual distance of the series is adjustable.

15. A system, comprising:

an excavator according to claim 1; and a mobile carrier provided with carrier means to which the suspension means of the excavator is attached.

16. The system according to claim 15, wherein the mobile carrier is a tracked vehicle.

17. The excavator according to claim 1, wherein the mobile carrier is a tracked vehicle.

18. The excavator according to claim 5, wherein the lateral guides are side walls which are attached to the frame.

19. The excavator according to claim 1, wherein the at least two series are rotatable with respect to each other about an axis which runs parallel to the at least two series.

20. The excavator according to claim 1, wherein the cutting elements of the same series have different widths, a cutting element of one of the series and having relatively large width being situated next to a cutting element of the other series and having a relatively small width.

* * * * *